US009492912B2

(12) United States Patent
Spirer

(10) Patent No.: US 9,492,912 B2
(45) Date of Patent: Nov. 15, 2016

(54) HYDRAULIC TORQUE WRENCH SYSTEM

(71) Applicant: Steven Spirer, Woodcliff Lake, NJ (US)

(72) Inventor: Steven Spirer, Woodcliff Lake, NJ (US)

( * ) Notice: Subject to any disclaimer, the term of this patent is extended or adjusted under 35 U.S.C. 154(b) by 493 days.

(21) Appl. No.: 14/184,813

(22) Filed: Feb. 20, 2014

(65) Prior Publication Data

US 2014/0238203 A1 Aug. 28, 2014

Related U.S. Application Data

(60) Provisional application No. 61/767,873, filed on Feb. 22, 2013.

(51) Int. Cl.

| | |
|---|---|
| ***B25B 17/00*** | (2006.01) |
| ***B25B 23/00*** | (2006.01) |
| ***B25B 21/00*** | (2006.01) |
| *B25B 13/46* | (2006.01) |

(52) U.S. Cl.
CPC ..... *B25B 23/0007* (2013.01); *B25B 21/005* (2013.01); *B25B 13/467* (2013.01)

(58) Field of Classification Search
CPC ..... B25B 23/0007; B25B 21/005; B25B 13/481; B25B 13/467; B25B 17/00; B25B 17/02
USPC ..... 81/57.3, 57.39
See application file for complete search history.

(56) References Cited

U.S. PATENT DOCUMENTS 4,336,727 A * 6/1982 Junkers ..... B25B 21/005 74/128
4,671,142 A * 6/1987 Junkers ..... B25B 13/463 81/57.39
5,016,502 A * 5/1991 Junkers ..... B25B 21/005 81/57.39
5,249,486 A * 10/1993 Thompson ..... B25B 21/005 81/57.39
D465,394 S * 11/2002 Junkers ..... D8/61
D491,436 S * 6/2004 Junkers ..... D8/61
6,912,933 B2 * 7/2005 Knopp ..... B23D 29/005 81/57.39
7,062,993 B2 * 6/2006 Shaw ..... B25B 21/005 81/54
7,082,858 B2 * 8/2006 Knopp ..... B23D 29/005 81/57.33
7,497,147 B2 * 3/2009 Koppenhoefer ..... B25B 21/005 81/57.39
7,926,389 B1 * 4/2011 Davis ..... B25B 21/005 81/57.39

(Continued)

*Primary Examiner* — Hadi Shakeri
*Assistant Examiner* — Danny Hong
(74) *Attorney, Agent, or Firm* — Stuart M. Goldstein

(57) ABSTRACT

A hydraulic torque wrench system has a power head and interchangeable link cartridge drives, insertable into the power head. A power head to cartridge drive connection system secures the cartridge drives into the power head forming a single unit having a torque line extending through the center line of the power head, in order to eliminate adverse reactive forces. A hydraulic hose coupler allows 360° by 360° coupler rotation. The link cartridge drives include a reaction pawl which controls the movement of the ratchet within the cartridge drive, a clam shell drive plate for an internal ratchet tooth cassette, a locking system to maintain a ratchet square drive in opposed lateral positions, and a reaction arm adjustment system for locking the reaction arm in a plurality of configurations in relation to the cartridge drive.

22 Claims, 15 Drawing Sheets

(56) References Cited

U.S. PATENT DOCUMENTS

| | | | | |
|---|---|---|---|---|
| D724,403 | S * | 3/2015 | Spirer | D8/61 |
| 2002/0121161 | A1 * | 9/2002 | Koppenhoefer | B25B 21/005 81/57.39 |

* cited by examiner

HYDRAULIC TORQUE WRENCH SYSTEM

RELATED APPLICATION

The herein application claims the benefit of provisional application Ser. No. 61/767,873 filed on Feb. 22, 2013.

FIELD OF THE INVENTION

The present invention relates to fluid operated torque wrenches for tightening and loosening threaded fasteners such as nuts and bolts, and more particularly to an improved, versatile, more effective and more efficiently functioning hydraulically operated torque wrench system.

BACKGROUND OF THE INVENTION

Hydraulically powered wrenches designed for the transmission of rotational power to threaded fasteners are well known and widely used tools in industry. There are a variety of different types of power wrenches, but a typical wrench design consists of a hydraulically driven, reciprocating piston within a driver in the form of a power head unit. Hose connection couplers for receiving hydraulic fluid are positioned in relation to the piston to receive hydraulic fluid which is transmitted to the piston. Such hose couplers are generally immovably connected to the power head unit or, at best, are rotatable in a single plane, thus limiting the manner and positions in which the hydraulic tool can be connected.

Once hydraulic fluid is transmitted through the couplers and into the power head, the piston is compelled to provide the necessary motion to transmit rotational movement, through drive linkages, to drive a ratchet which then engages, to tighten or loosen, a threaded fastener.

During the period of time a threaded fastener is being tightened, it is usually necessary to brace the wrench against a stable, immoveable support structure to prevent unsafe reactive rotation of the wrench. This is often accomplished by providing a reaction arm which extends from the wrench and is designed to contact the support structure during rotation of the ratchet. Such reaction arm components are most often immovably attached to and extend out from the wrench. This configuration, however, severely limits the location and the position in which the wrench can be used, since the wrench can only be placed in an area where there is a suitably fixed support structure to safely accommodate the fixed reaction arm.

Many common hydraulic torque wrenches also are now utilizing a power head and separate, independent, link cartridge drives insertably connected within the power head. There are a variety of cartridge drives, each having different ratcheting arrangements, depending on the type of fastener which must be tightened or removed. However, the current systems do not permit power head to cartridge drive connections which are readily adaptable for quick, simple and reliable attachment of these components. In addition, current power head/cartridge drive wrench systems result in undue reactive side load and tension forces, during rotational operation of the ratchet. These forces create unbalanced, rotational torque through the wrench components which is not only dangerous, but also decreases the efficiency of the ratcheting operation and the longevity and thus the effectiveness of the tool.

SUMMARY OF INVENTION

It is the object of the present invention to provide a hydraulic torque wrench system which overcomes the limitations and disadvantages of current systems.

It is an object of the present invention to provide a hydraulic torque wrench system having a hydraulic wrench power head and a plurality of link cartridge drives, each of which can be easily and readily inserted and positioned to the power head by a secure and safe power head to cartridge drive connection system.

It is another object of the present invention to provide a hydraulic torque wrench system which has a power head and a plurality of unique cartridge drives, each cartridge drive, when inserted and connected to the power head, forming an integral unit in combination with the power head, having a torque line through the center line of the power head, parallel to the longitudinal axis of the cartridge, so as to prevent side load and tension forces within the unit.

It is still another object of the present invention to provide a hydraulic torque wrench system which provides the option of utilizing a link cartridge drive having a dual component drive plate, and internal ratchet tooth configuration which serves to enhance both tool integrity and safety.

It is a further object of the present invention to provide a hydraulic torque wrench system which has hydraulic hose couplers providing 360° by 360° rotation in two planes, to allow easy positioning and management of hydraulic hoses running to the power head of the system.

It is another object of the present invention to provide a hydraulic torque wrench system which has a cartridge drive with a reaction pawl rotatable between a first position preventing rotatable movement of the ratchet within the cartridge drive and a second position allowing movement of the ratchet within the cartridge drive.

It is still another object of the present invention to provide a hydraulic torque wrench system having a link cartridge drive with a ratchet square drive and a locking system to maintain the square drive in a first extended position on one side of the cartridge drive and a second position on the opposite side of the cartridge drive.

It is a further object of the present invention to provide a hydraulic torque wrench system having a link cartridge drive with a reaction arm and a reaction arm adjustment system for positioning and locking the reaction arm in a plurality of different configurations in relation to the cartridge drive.

These and other objects of the invention are accomplished by the present invention, a hydraulic torque wrench system comprising a hydraulic wrench power head and a plurality of interchangeable link cartridge drives, insertable into the power head. A unique power head to cartridge drive connection system secures each of the cartridge drives, individually, into the power head to form a single unit having a torque line extending through the center line of the power head, parallel to the longitudinal axis of the cartridge drive at its pivot point, in order to substantially eliminate reactive side load and tension forces during rotational operation of the ratchet in the system. A novel hydraulic hose coupler swivel which allows 360° by 360° rotation in two planes is provided in the system. Significant features of the link cartridge drives include a reaction pawl which controls the movement of the ratchet within the cartridge drive, a clam shell, two piece drive plate for an internal ratchet tooth cassette, a locking system to maintain a ratchet square drive in opposed lateral positions in relation to the cartridge drive, and a reaction arm and reaction arm adjustment system on one of the cartridge drives for positioning and locking the reaction arm in a plurality of different configurations in relation to the cartridge drive.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
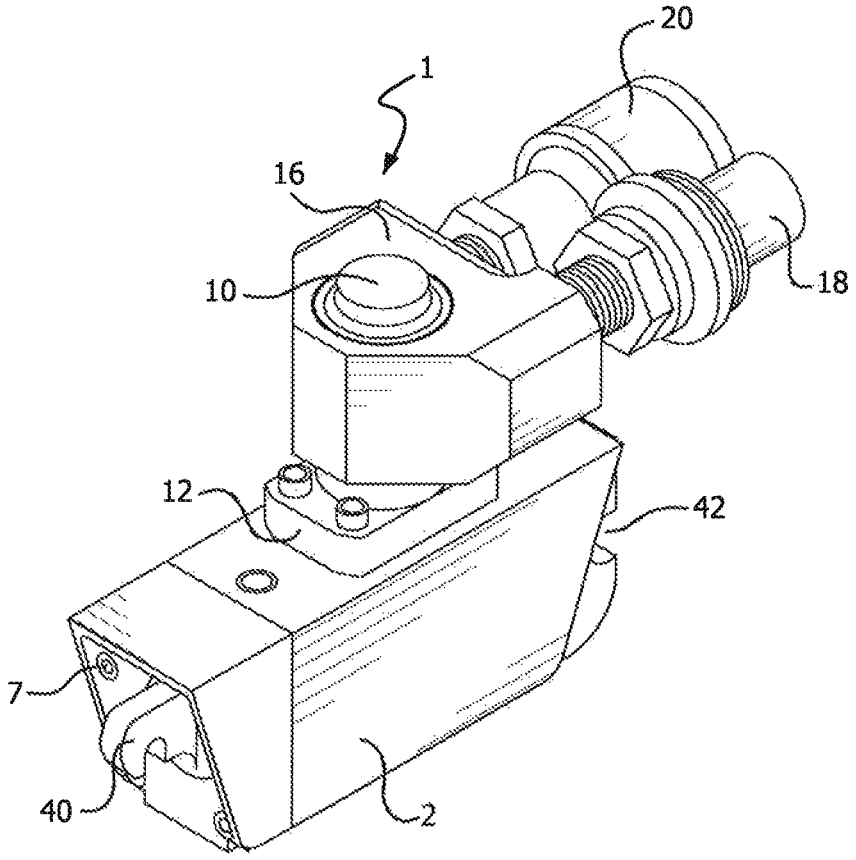
FIG. 1 is a perspective view of the power head of the hydraulic torque wrench system of the present invention.
Figure 2:
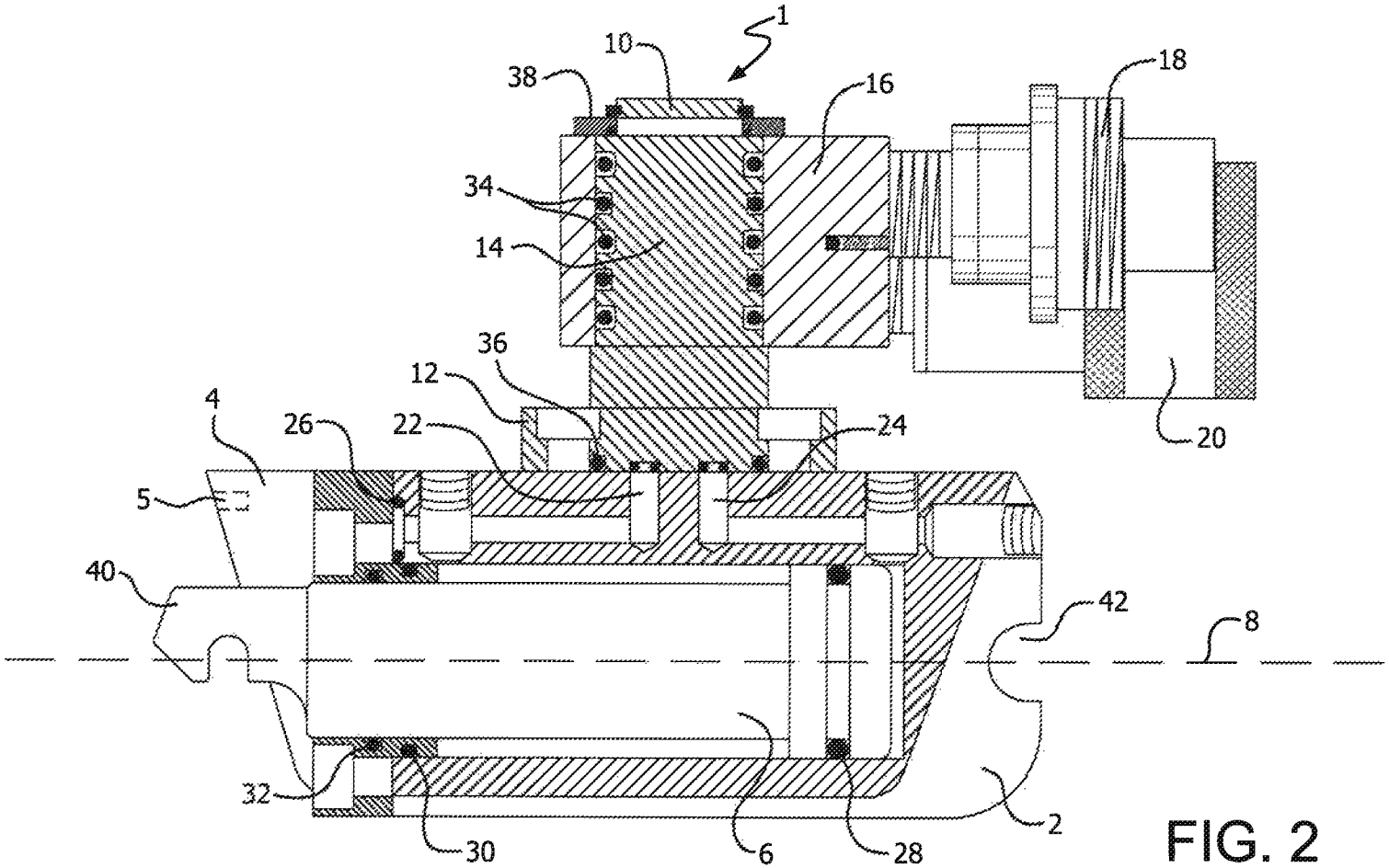
FIG. 2 is a cross-sectional view of the power head of the present invention.
Figure 3:
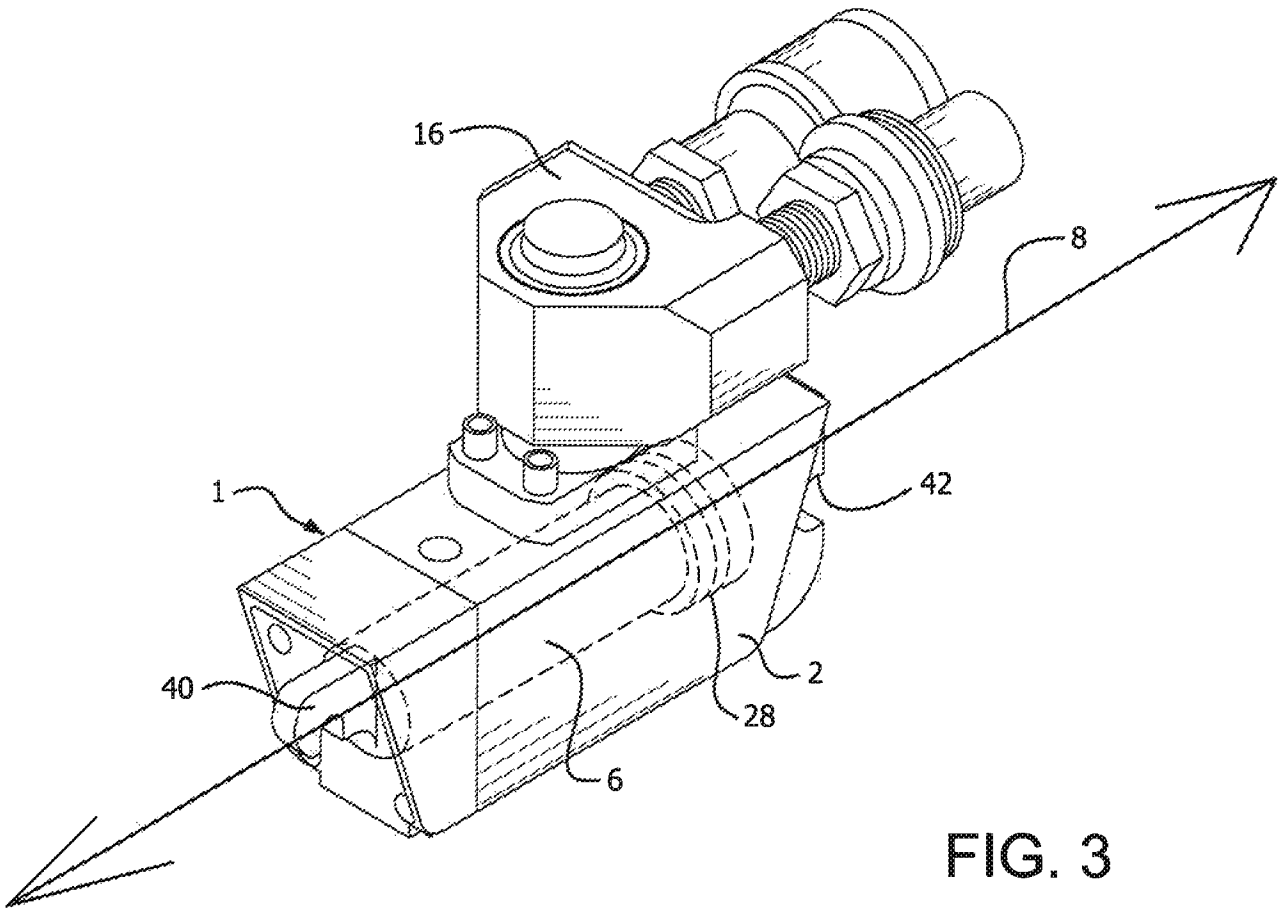
FIG. 3 is a perspective view, partly ghosted, showing the torque line created by the power head of the present invention.
Figure 4:
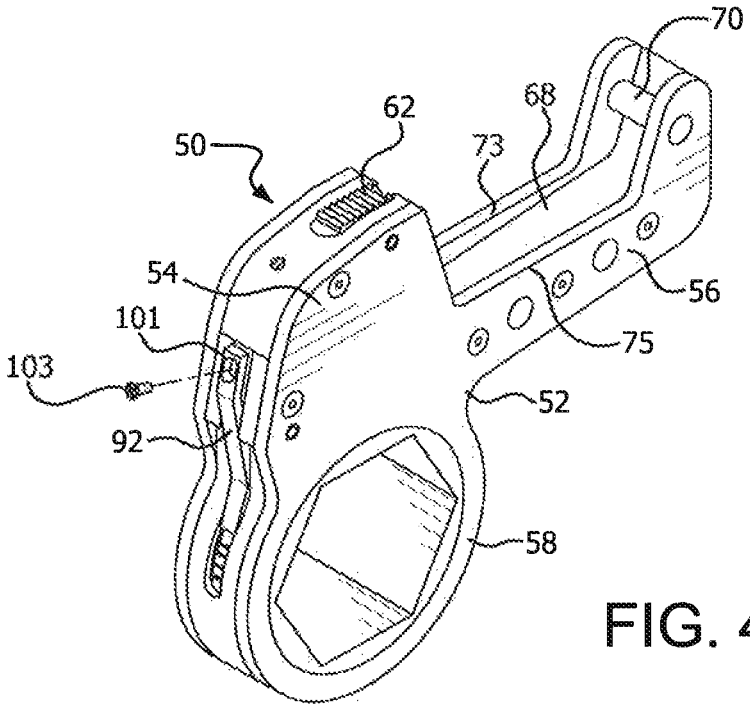
FIG. 4 is a perspective view of one of the cartridge drives of the present invention.

The hydraulic torque wrench system of the present invention comprises a single hydraulic wrench power head 1 to be used with interchangeable link cartridge drives 50, 110, and 170. Power head 1 is configured to be inserted into each of the cartridge drives to form an integral torque wrench unit. Cartridge drive 50 is utilized in combination with power head 1 to tighten hex nuts in low profile applications. Cartridge drive 110 is utilized in combination with power head 1 for hyper-low clearance applications. This cartridge drive is adapted for attachment to a choice of three spanner ratchet cassettes, i.e. a unique totally enclosed ratcheting hyper low-profile hex link 136, as well as a commonly used non-ratcheting spanner link and a swing-open non-ratcheting cassette utilized around jam nuts. Cartridge 170, also used in combination with power head 1, comprises a dedicated square drive for socket driven applications.

Power head 1 comprises cylinder 2 with end cap 4. Latch arm openings 5 and 7 are located on each side of end cap 4. Internal piston 6 resides within cylinder 2. Longitudinal axis 8 extends through the centerline of power head 1. Port stem component 10 comprises port stem base section 12 located on the top surface of cylinder 2, and port stem section 14 extending up from the port stem base section. Port block 16 circumscribes port stem 10. Hydraulic hose male coupler 18 and female hydraulic hose coupler 20 are connected to the port block. This configuration allows the port block, with male and female coupler attached, 360° rotation in a single plane around the port stem. Hydraulic fluid passages 22 and 24 extend within housing 2, between port stem base section 12, to supply cylinder 2 with hydraulic fluid to drive reciprocating piston 6, as is known in the art. Appropriate "O" rings, i.e. housing O-ring 26, piston O-ring 28, end cap O-rings 30 and 32, port stem O-rings 34, port stem base section O-rings 36, and port washer O-ring 38, are provided for sealing fluid within power head 1.

Power head 1 further comprises a forward connecting component of piston 6 in the form of latch hook 40 and a rear connecting receptacle in the form of partially open channel 42. These connecting components are configured to matingly engage the various cartridge drives in order to secure power head 1 to the drives.

Figure 7:
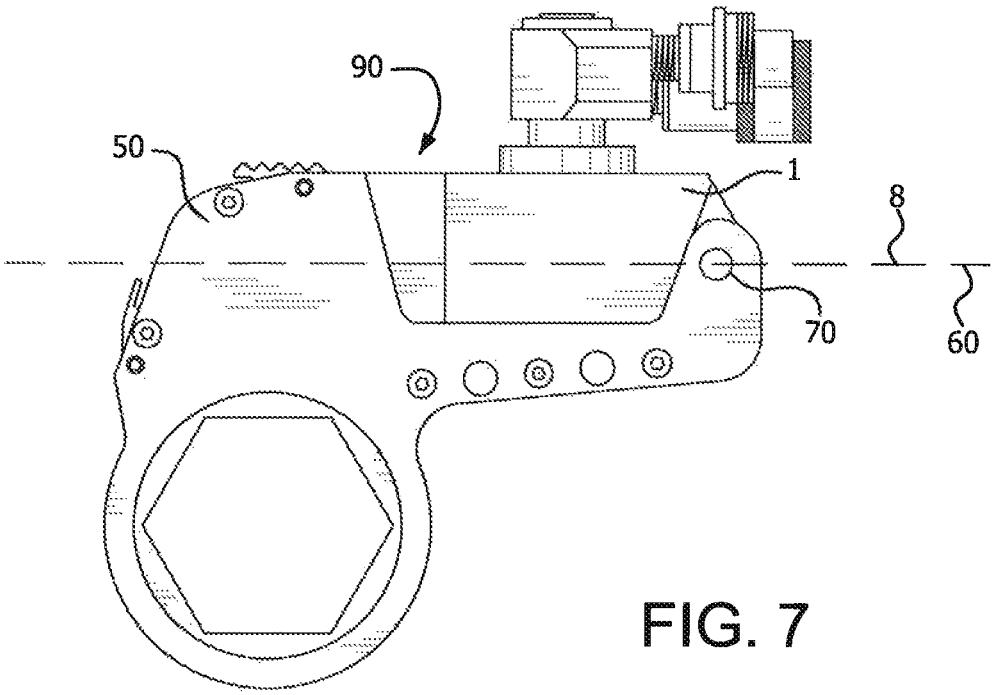
FIG. 7 is an elevation view of the unit shown in FIG. 6.
Figure 8:
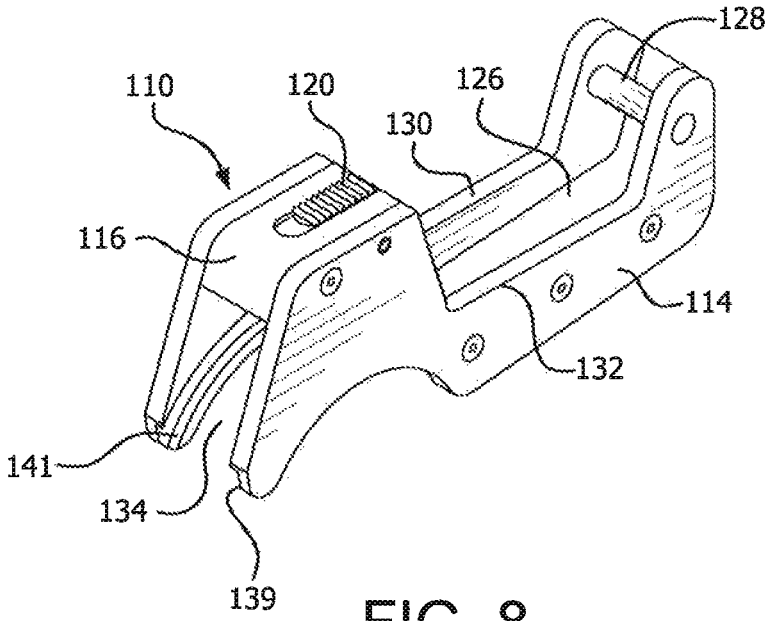
FIG. 8 is a perspective view of another cartridge drive of the present invention.

Cartridge drive 50 comprises housing 52 having front housing section 54 with rear housing section 56, and lower housing section 58. Longitudinal axis 60 of cartridge drive 50 extends through its rear and front housing sections. See FIG. 7.

Figure 5:
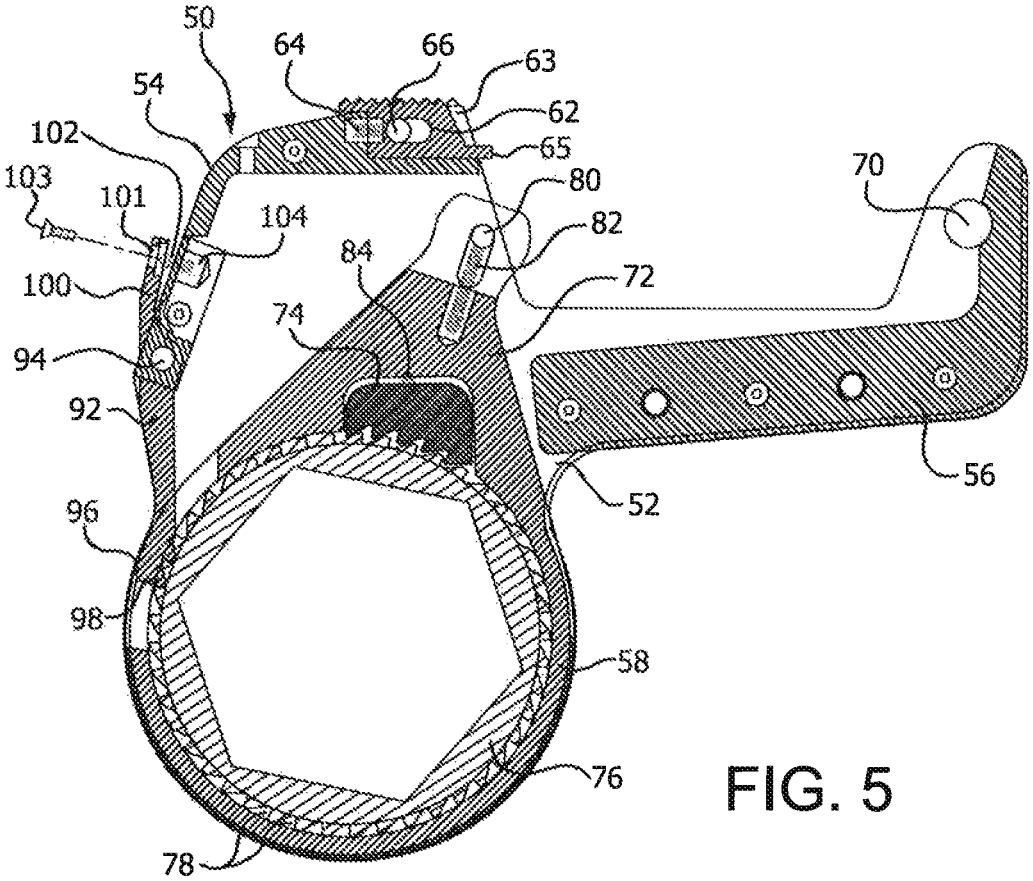
FIG. 5 is a cross-sectional view of the cartridge drive shown in FIG. 4.

Latch 62, having laterally spaced latch arms 65 (only one of which is shown in FIG. 5) is located atop front housing section 54 of housing 52, within latch channel 63. Latch 62 is spring loaded by means of latch spring 64. Top spacer 66 assists in maintaining latch 62 in position within latch channel 63. Rear housing section 56 of housing 52 has internal channel 68 extending substantially the length of rear section. Channel 68 is sized to receive outer housing 2 of power head 1. Reaction pin 70 extends between side walls 73 and 75 at the rear end of rear housing section 56.

Lower housing section 58 of housing 52 encloses drive plate 72, drive pawl 74, and ratchet 76 with ratchet teeth 78. Drive pin 80 connects drive plate 72 to front housing section 54 via drive spring 82. Drive pawl spring 84 interacts between drive pawl 74 and drive plate 72.

Power head 1, and specifically its cylinder 2, is inserted into channel 68 of cartridge drive 50, such that its rear partly open receptacle 42 is positioned around reaction pin 70 at the rear end of rear housing section 56. Power head 1 is then pivoted slightly downward, towards front housing section 54. Spring loaded latch 62 atop front housing section 54 of cartridge drive housing 50 is pushed forward within latch channel 67, against the bias of latch spring 64. This causes latch arms 65 to also retract into latch channel 63.

Figure 6:
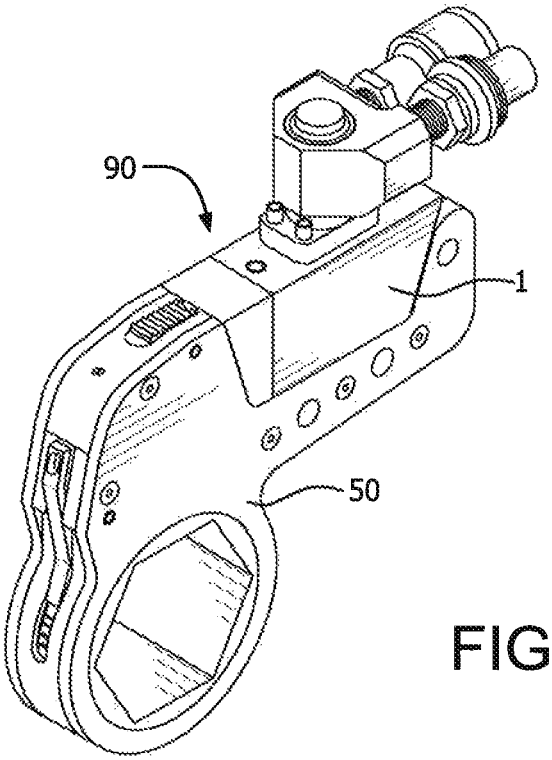
FIG. 6 is a perspective view of the integral unit formed by the connection of the power head and the cartridge drive shown in FIGS. 4 and 5.

Continued pivoting of power head 1 downward, results in the power head becoming seated and nestled within cartridge drive 50, with latch hook 40 within latch channel 63, between latch arms 65. At this point, latch 62 is released, such that latch spring 64 is no longer biased inward. When released, the latch spring compels latch 62 towards seated power head 1. Latch arms 65 are likewise compelled towards power head 1 and into latch arm openings 5 and 7 in the power head, where they biasedly remain. Latch hook 40 of piston 6 of power head 1 is thusly inserted into the internal channel 68, thereby securing power head 1 to cartridge drive 50 as single, integrated unit 90. See FIGS. 6 and 7. In this configuration, longitudinal axis/centerline 8 of power head 1 is parallel and aligned with longitudinal axis 60 of cartridge drive 50.

Once power head 1 is secured within cartridge drive 50 forming unit 90, tightening or loosening of fasteners by ratchet 76, driven by the power head, as is known in the art, can be accomplished. However, significant and unique to the herein invention, is that power head 1 is positioned within cartridge drive 50 by a pivot point, the pivoted connection reaction pin 70 around receptacle 42. By this configuration, power head centerline 8 is at all times parallel to and aligned with longitudinal axis 60 of the cartridge drive, with the torque line of unit 90 running through the center line of the power head and reaction pin 70 of cartridge drive 50. The positioning of this center unit torque line prevents excessive side load and tension forces on the power head and its internal cylinder and piston, thus greatly enhancing safety, not to mention greatly eliminating these adverse forces which serve to decrease the longevity of all the wrench components.

Of course it will be appreciated that to remove power head 1 from cartridge drive 50, latch 62 is simply again compelled forward, against the bias of latch spring 64. This also serves to withdraw latch arms 65 from latch arm openings 5 and 7 of power head 1, allowing the power head to be removed from cartridge drive 50.

Cartridge drive 50 also comprises a novel system to control the rotatable movement of ratchet 76. Reaction pawl 92 is rotatably mounted to upper housing section 54 of cartridge drive 50 by reaction pawl spacer pin 94. Bottom end 96 of reaction pawl 92 has reaction pawl teeth 98 which are configured to engage and mesh with ratchet teeth 78 of ratchet 76. Top end 100 of reaction pawl 92 is compelled away from upper housing section 54 by reaction pawl spring 102, located within slot opening 104 in the upper housing section. In this position, bottom end 96 of reaction pawl 92 engages ratchet teeth 78, to prevent all rotatable movement of ratchet 76. Pushing top end 100 of reaction pawl 92 towards upper housing section 54 compels the top end to move against the bias of reaction pa spring 102. This results in the reaction pawl rotating about reaction pawl pin 94, thereby lifting reaction pawl teeth 98 off ratchet teeth 78 and permitting free rotation of ratchet 76.

Reaction pawl 92 can also be immoveably secured in a ratchet teeth disengaged position by pawl teeth locking means. Fastener 103 is provided to be threadably connected within opening 101 at top end 100 of reaction pawl 92. When fully screwed into opening 101, fastener 103 compels top end 100 of reaction pawl 92 adjacent to housing section. 54. This rotates reaction pawl 92 rotates about pawl spacer pin 94. Reaction pawl teeth 98 are then lifted and maintained off of ratchet teeth 78, until fastener 103 is removed.

Figure 9:
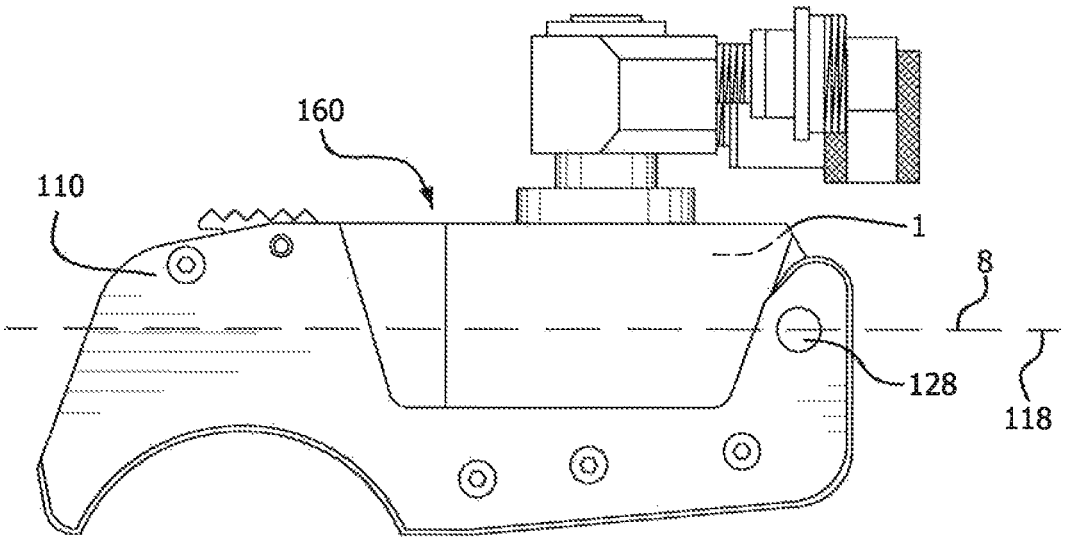
FIG. 9 is an elevation view of the integral unit formed by the connection of the power head and the cartridge drive shown in FIG. 8.
Figure 10:
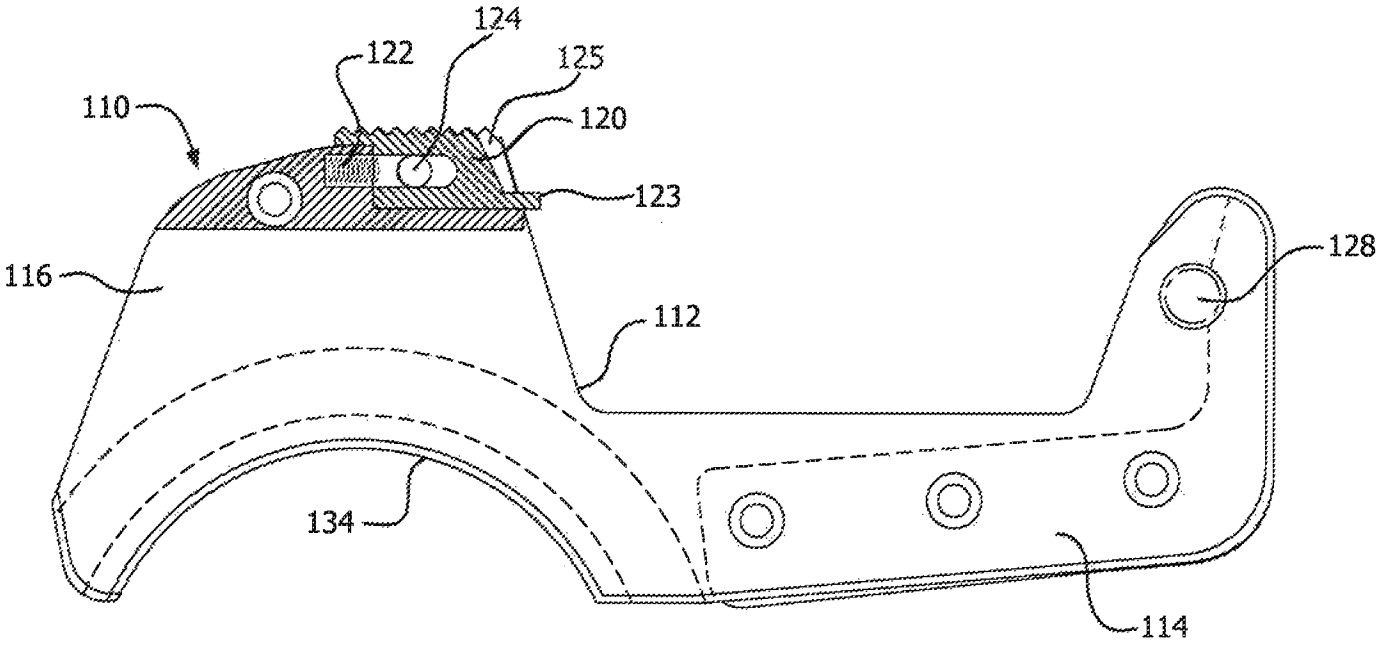
FIG. 10 is a partial cross-sectional view of the cartridge drive shown in FIG. 8.
Figure 11:
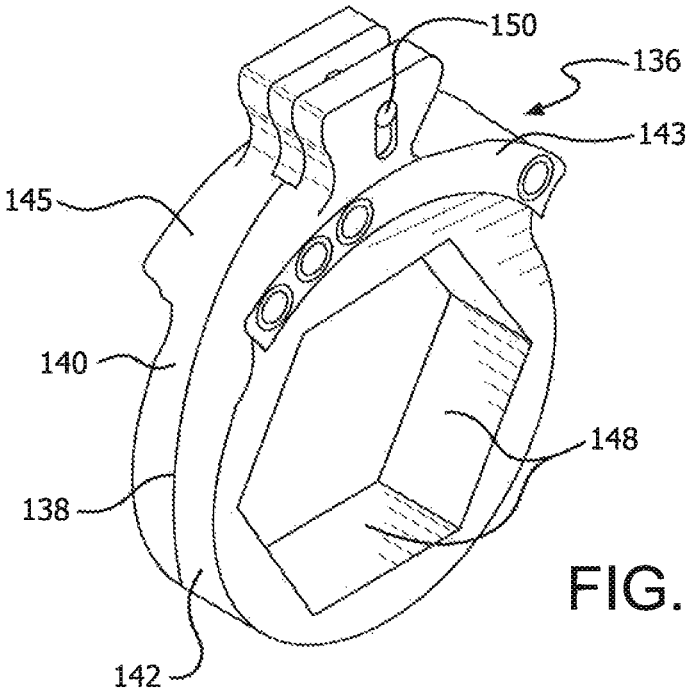
FIG. 11 is a perspective view of the unique ratchet cassette utilized in the cartridge drive shown in FIGS. 8 and 10.
Figure 12:
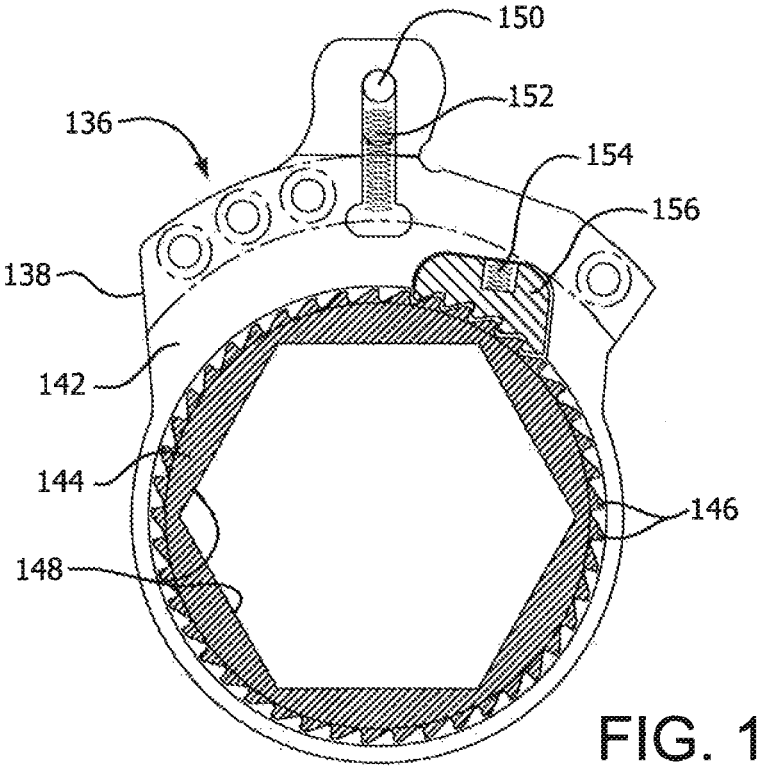
FIG. 12 is a cross-sectional view of the ratchet cassette shown in FIG. 11.
Figure 13:
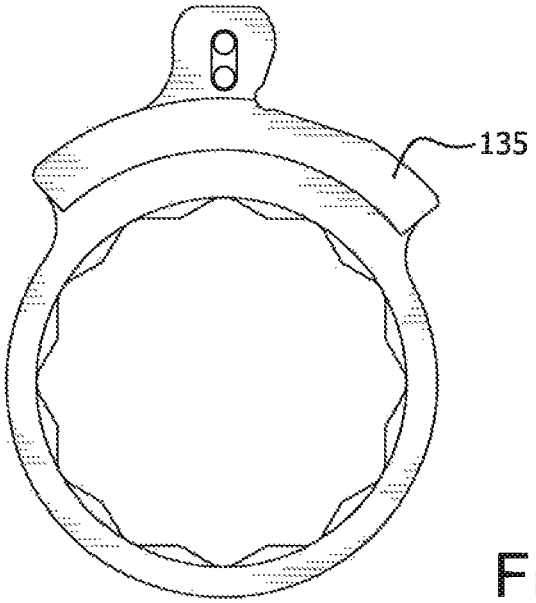
FIG. 13 is a front view of a non-ratcheting spanner to be used with the cartridge drive shown in FIGS. 8-10.
Figure 14:
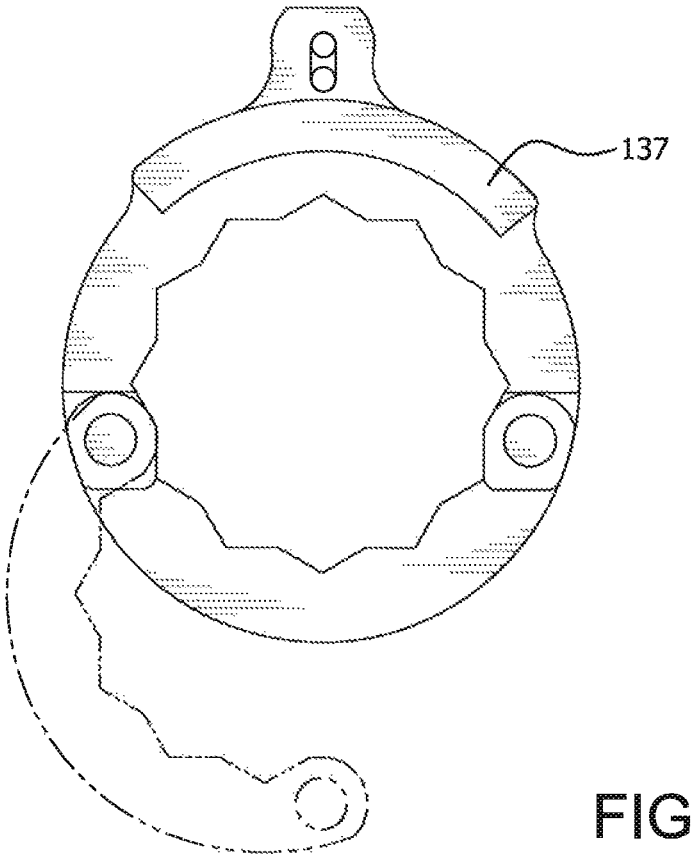
FIG. 14 is a front view of a split-link spanner to be used with the cartridge drive shown in FIGS. 8-10.

Cartridge drive 110 comprises housing 112 having rear housing section 114 and front housing section 116. Longitudinal axis 118 of cartridge drive 110 extends through its rear and front housing sections. See FIG. 9. As has been described with regard to cartridge drive 50, latch 120, having laterally spaced latch arms 123, is located atop front housing section 116 of housing 112, within latch channel 125. Latch 120 is spring loaded by means of latch spring 122. Top spacer 124 assists in maintaining latch 120 in position within latch channel 125. Rear housing section 114 of housing 112 has internal channel 126 extending substantially the length of the rear section. Channel 126 is sized to receive outer housing 2 of power head 1. Reaction pin 128 extends between side walls 130 and 132 at the rear end of rear housing section 114.

Front housing section 116 of cartridge drive 110 comprises curved channel receptacle 134 configured to accept a variety of independent, separate spanner ratchet cassettes, e.g. non-ratcheting spanners 135, split-link spanners 137, and ratchet cassette 136 of the subject invention. Curved channel receptacle 134 has female keyway slot 139 extending out from sidewall 132 and smaller female keyway slot 141 extending out from side wall 130.

Ratchet cassette 136 represents a new design for an enclosed ratcheting hyper low-profile hex link. This ratchet cassette utilizes a "clam shell" type construction which comprises drive plate 138 having dual half sections 140 and 142 which are interconnected by appropriate screw fasteners. Drive plate half sections 138 and 140 enclose ratchet 144 having flat interior surfaces 148 and exterior ratchet teeth 146 adjacent to the internal surfaces of the drive plate. In this manner, drive plate 138 keeps hidden and protects ratchet teeth 146, as flat internal surfaces 148 of the ratchet are rotated for its tightening and loosening functions. Also enclosed within drive plate half sections 138 and 140 is drive pin 150, biased in position via drive spring 152.

Ratchet cassette 136 fits into and is connected within channel receptacle 134 of front housing section 116 such that male keyway 143 of the ratchet cassette fits into female keyway slot 139 of the channel receptacle and male keyway 145 of the ratchet cassette fits into smaller female keyway slot 141 of the channel receptacle. By this configuration, ratchet cassette can only be positioned in one direction within channel receptacle 134, thus avoiding any possibility that the ratchet cassette would be inserted backwards. After proper insertion of ratchet cassette 136 into channel receptacle 134, the ratchet cassette is secured in position by means of commonly utilized screws or like connectors. Upon actuation of piston 6 in power head 1, drive pawl 156, biased by drive pawl spring 152, rotates ratchet 144 within front housing section 116 to tighten or loosen fasteners.

Power head 1 itself is inserted into channel 126 and secured within cartridge drive 110 in the same manner as has been described previously with regard to the connection between the power head and cartridge drive 50. Once again, in this configuration, in which power head 1 and cartridge drive 110 form integral unit 160, longitudinal axis/centerline 8 of the power head is at all times parallel to longitudinal axis 118, extending through reaction pin 128 of the cartridge drive. See FIG. 9. As has also already been described, this creates a torque line, at centerline 8 through unit 160, which prevents the excessive loads and adverse forces inherent in other hydraulic torque wrench systems.

it is understood that other spanner ratchet cassettes are connected to cartridge drive 110 in the same manner as ratchet cassette 136 and, when so connected, the identical torque line is established, creating the same favorable results and preventing the same deleterious forces.

Figure 17:
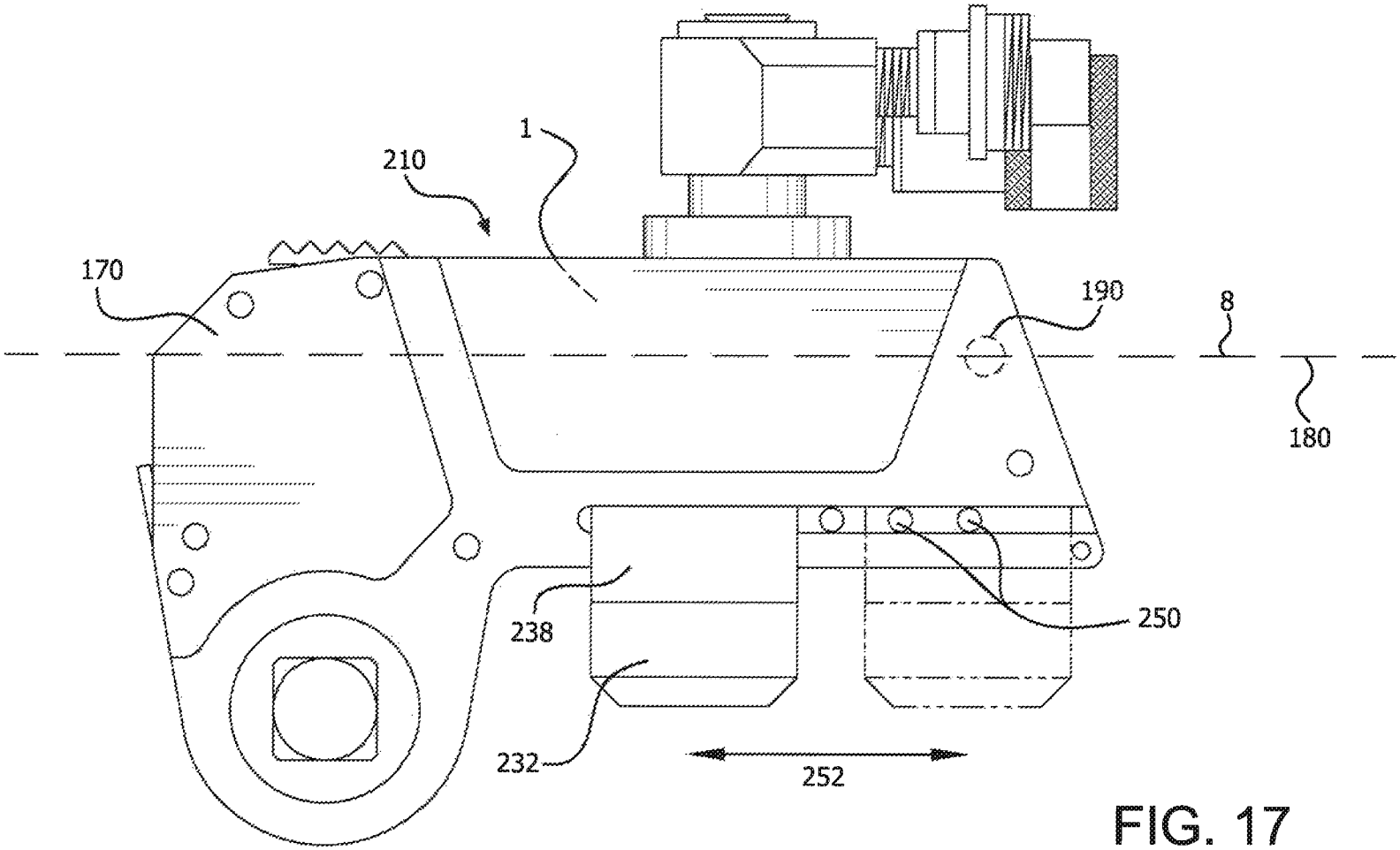
FIG. 17 is an elevation view of the integral unit formed by the connection of the power head to cartridge drive shown in FIGS. 13 and 14.

Cartridge drive 170 is a drive unit with a dedicated square drive system used for socket driven purposes. Cartridge drive 170 comprises housing 172 having front housing section 174, rear housing section 176 and lower housing section 178. Longitudinal axis 180 of cartridge drive 170 extends through its rear and front housing sections. See FIG. 17.

As has been described with regard to cartridge drive 50, latch 182, having laterally spaced latch arms 183, is located atop of front housing section 174 of housing 172, within latch channel 185. Latch 182 is spring loaded by means of latch spring 184. Top spacer 186 assists in maintaining latch 182 in position within latch channel 185. Rear housing section 176 of housing 172 has internal channel 188 extending substantially the length of the rear housing section. Channel 188 is sized to receive outer housing 2 of power head 1. Reaction pin 190 extends between side walls 191 and 192 at the rear end of rear housing section 176.

Lower housing section 178 of housing 172 encloses drive plate 194, drive pawl 196, and ratchet 198 with ratchet teeth 200. Drive pin 202, biased by drive spring 204, connects drive plate 194 to front housing section 174. Drive pawl spring 206 interacts between drive pawl 196 and drive plate 194.

Power head 1 is inserted into channel 188 and secured within cartridge drive 170 in the same manner as has been described previously with regard to the connection between the power head and cartridge drive 50 and 110. As with these connections, when power head 1 and cartridge drive 170 are attached, forming integral unit 210, longitudinal axis/centerline 8 of the power head at all times remains parallel to longitudinal axis 180, extending through reaction pin 190 of the cartridge drive. See FIG. 17. Once again, this creates a torque line through the centerline of power head 1 and hence unit 210, resulting in the favorable absence of tensile and rotational forces while the unit is in rotational operation.

Control of the rotatable movement of ratchet 198 of cartridge drive 170, as described with reference to cartridge drive 50, is also a feature utilized on cartridge drive 170. Reaction pawl 212, in this case rotatably mounted to lower housing section 178, has reaction pawl teeth 214 which are configured to engage and mesh with ratchet teeth 200 of ratchet 198 to prevent the rotation of the ratchet. Pushing top end 216 of ratchet pawl 212 against the bias of reaction pawl spring 218 rotates the reaction pawl about reaction pawl l pin 220, thus disengaging reaction pawl teeth 214 from ratchet teeth 200, allowing rotatable movement of ratchet 198.

Cartridge drive 170 also comprises a novel feature which positions ratchet square 222 such that the ratchet square can be located on either side of housing 172.

Figure 15:
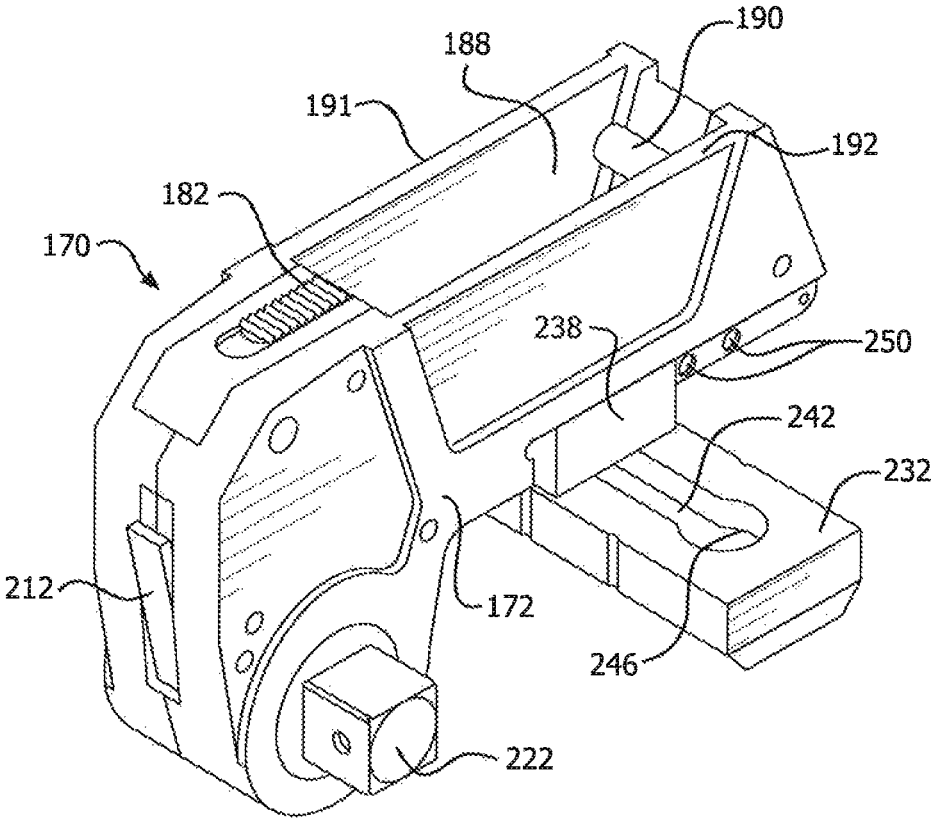
FIG. 15 is a perspective view of another cartridge drive of the present invention.
Figure 16:
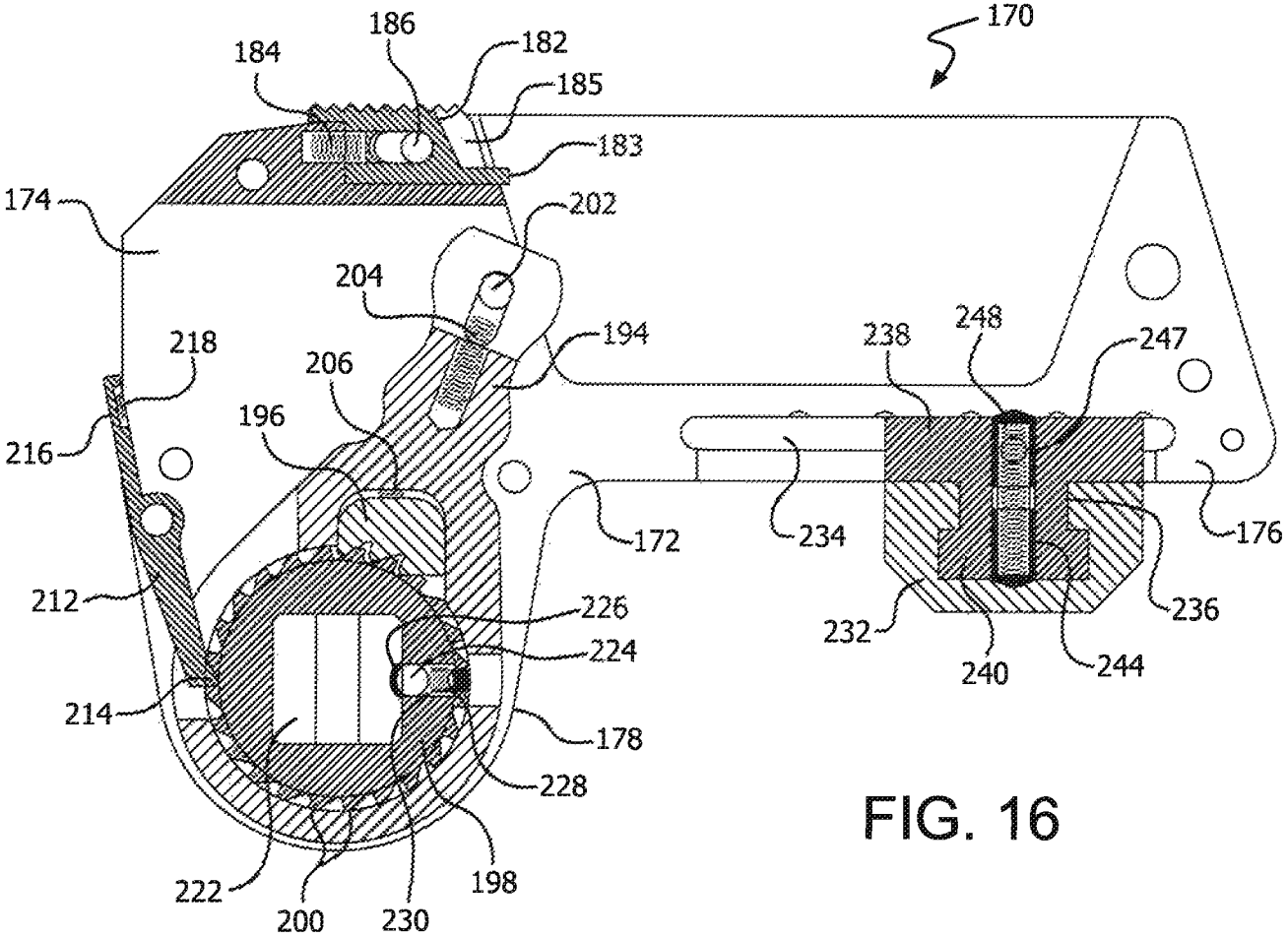
FIG. 16 is a cross-sectional view of the cartridge drive shown in FIG. 13.

Ratchet square 222 is located within a center opening in ratchet 198 and is locked at one side of housing 172 by square drive ball lock 224, biased in position in a first notched detent 226 within the ratchet square, by square drive spring 228. The spring is located in slot 230 through ratchet 198. FIGS. 15 and 16 show ratchet square 222 locked in a first position, extending laterally of housing 172. From this position, ratchet square 222 can be pushed inward towards housing 172. This compels ratchet square 222 to move out of detent 226 and slide along ball lock 224 into a second notched detent (not explicitly shown, but present, as would be appreciated by one of ordinary skill), spaced apart from the first detent within ratchet 198, thus locking the ratchet square in lateral position extending out of the opposite side of housing 172. In this manner, integral unit 210 has increased versatility, in that it can be utilized to address socket driven fasteners on either side of the unit.

Cartridge drive 170 also comprises a highly versatile reaction arm 232 and reaction arm adjustment system for positioning and locking the reaction arm in a plurality of different configurations in relation to housing 172. These many configurations can be easily accomplished without the use of tools or the addition or removal of extraneous components.

Figure 18:
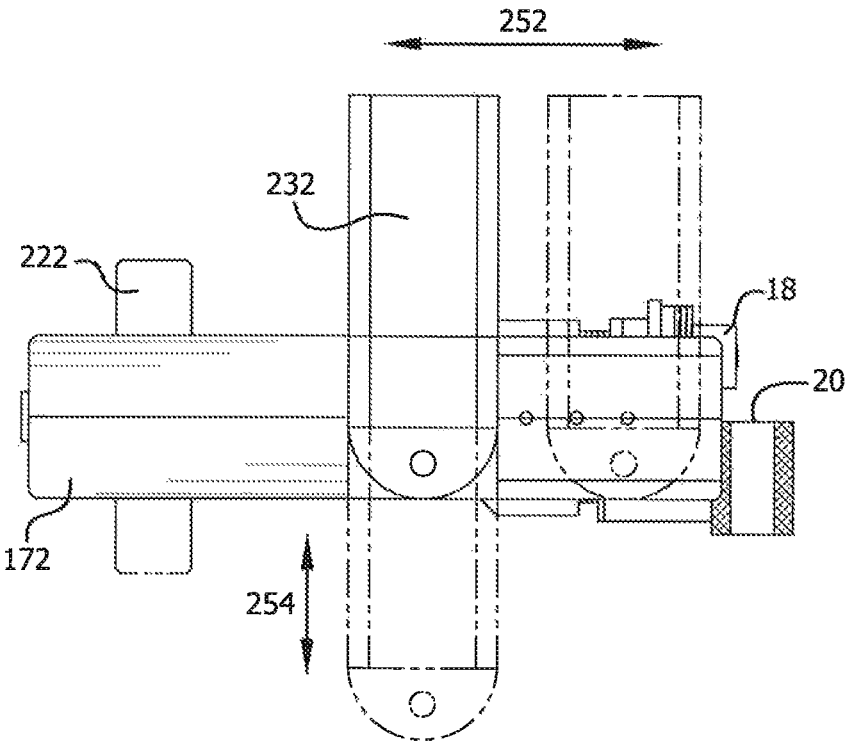
FIGS. 18 and 19 are bottom views of the cartridge drive shown in FIGS. 15-17, illustrating the adjustability of its reaction arm, in accordance with the present invention.
Figure 19:
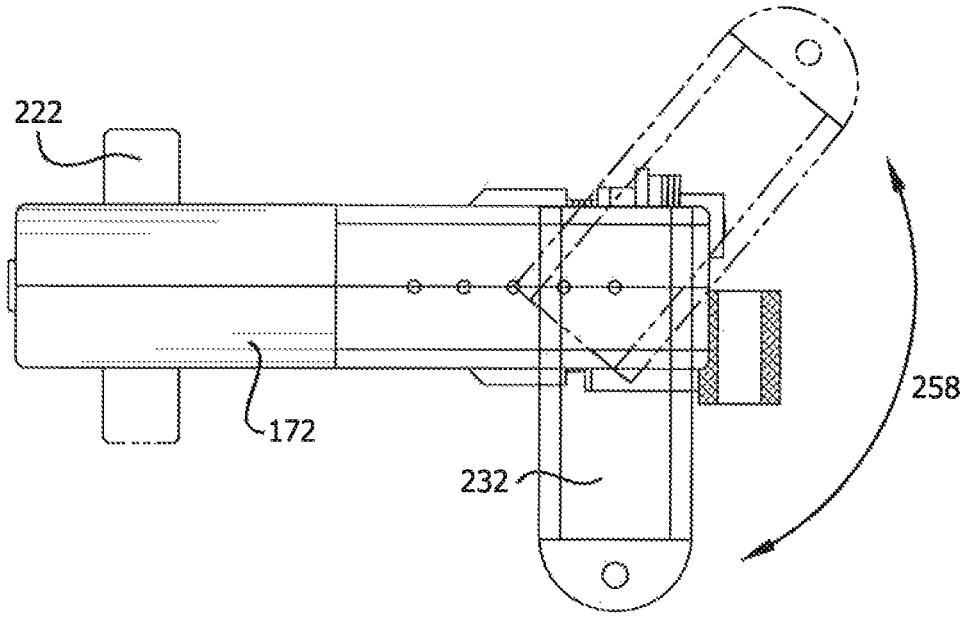
Figure 21:
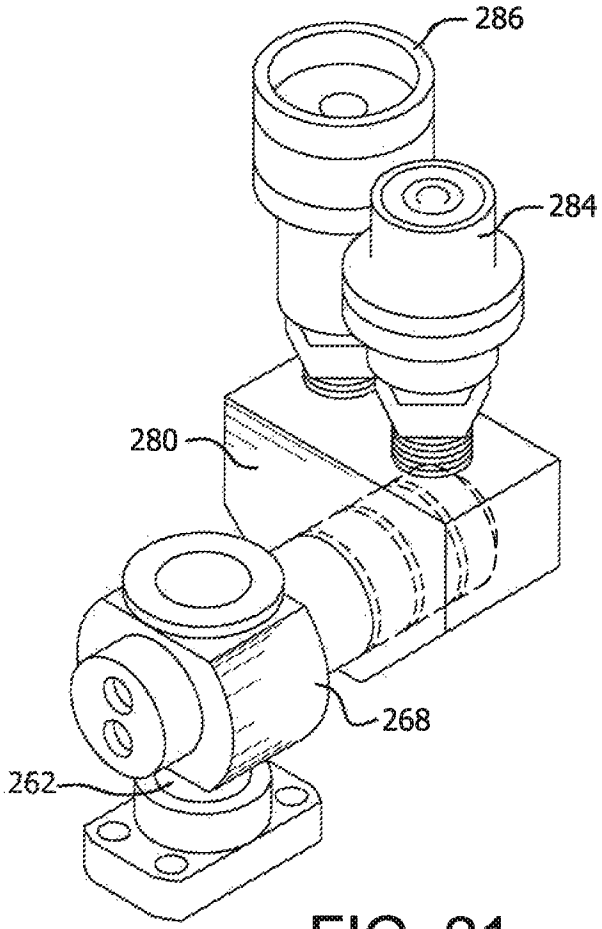
FIG. 21 is a perspective view, partial ghosted, showing the components shown in FIG. 20.
Figure 20:
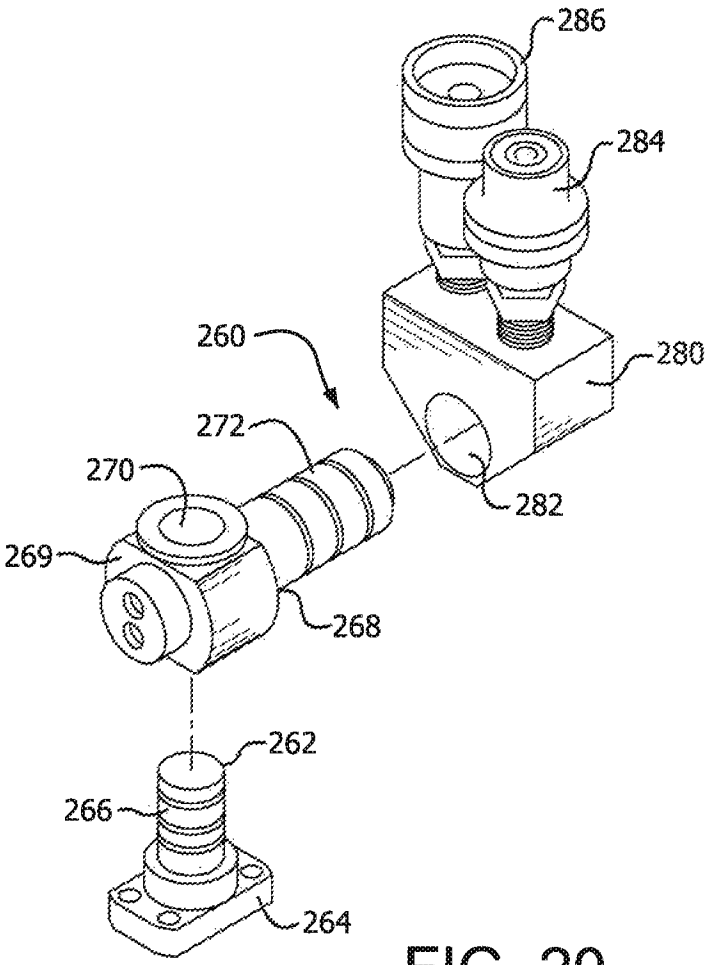
FIG. 20 shows the components of the hydraulic coupler swivel connection of the present invention.

The reaction arm adjustment system comprises elongated, slotted channel 234 extending along the outer surface of rear housing section 176. Reaction arm slider block 236 has upper section 238 which is slideable along channel 234 and lower section 240 slideable within slotted channel 242 indented within reaction arm 232. Slotted channel 242 has circular end 246 with a diameter larger than the width of the channel. A stop block, not shown, is located at the other end of channel 242. Reaction arm ball plunger 244 is held within both the upper section 238 and lower section 240 of reaction arm block 236, by reaction arm set screw 247 and biasedly seated therein by reaction arm spring 248. Ball plunger 244 is locked along various locations along channel 242 by being biasedly compelled into notched openings 250. This permits slideable movement 252 of upper section 238 of reaction arm block 236 within channel 234 and along the outer surface of rear housing section 172, and of slideable movement 254 of reaction arm 232 along lower section 240 of the reaction arm block. These slideable movements, that is the movement of upper section 238 along channel 234 and the movement of reaction arm 232 along lower section 240, are perpendicular to each other, permitting the reaction arm to be set in a variety of positions in relation to housing 172, with 360° adjustability 258 in order to attain a plurality of different reaction arm configurations and applications. See FIGS. 18 and 19.

The present invention also contemplates the use of a novel hose coupling swivel connection 260 adaptable for to be included on power head 1, regardless of which cartridge drive is being used. This connection utilizes port stem component 262 comprising port stem base section 264 secured on housing 2 of power head 1, and port stem section 266 extending up from the port stem base section. However, instead of port block 16 circumscribing port stem component 10 as is now commonly done to permit 360° rotation in a single plane around the port stem component, e.g. see FIGS. 1 and 22, uniquely designed, integral, unitary arm element 268 with end section 269 having opening 270. Port stem section 266 is inserted within opening 270 such that arm element 268 is perpendicular to the port stem section and is rotatable 360° in a single plane around the port stem section. Extended end section 272 of arm element 268 is inserted into opening 282 of port block 280, such that the arm element is perpendicular to the port block and is rotatable 360° about the extended end section of the arm element, albeit it is also rotatable within a second plane perpendicular to the plane in which the arm element rotates around port stem section 256. Appropriately positioned O-rings are located around the circular slots around port stem section 266 and extended end section 272 of arm element 268 for fluid sealing purposes. Male and female house couplers 284 and 286 are connected to port block 280, as previously described.

Figure 22:
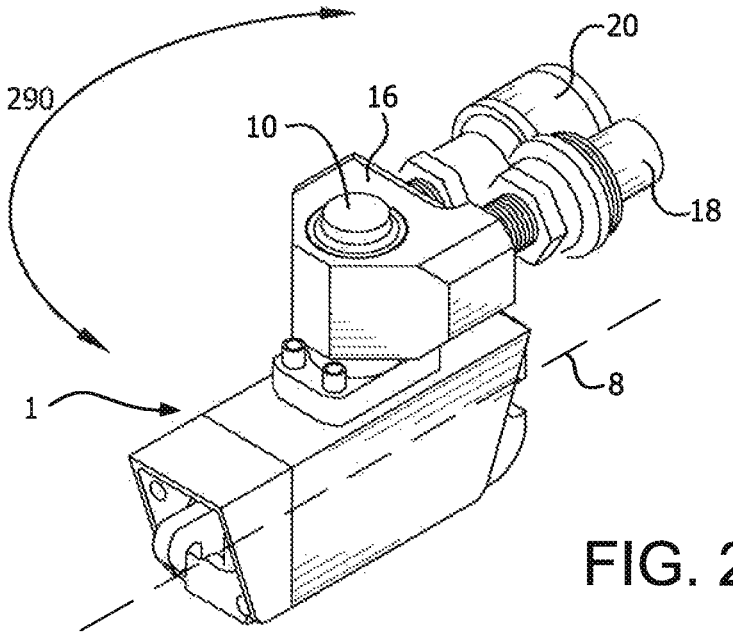
FIG. 22 illustrates the functioning of commonly used coupler swivel connection utilized on a power head unit.
Figure 23:
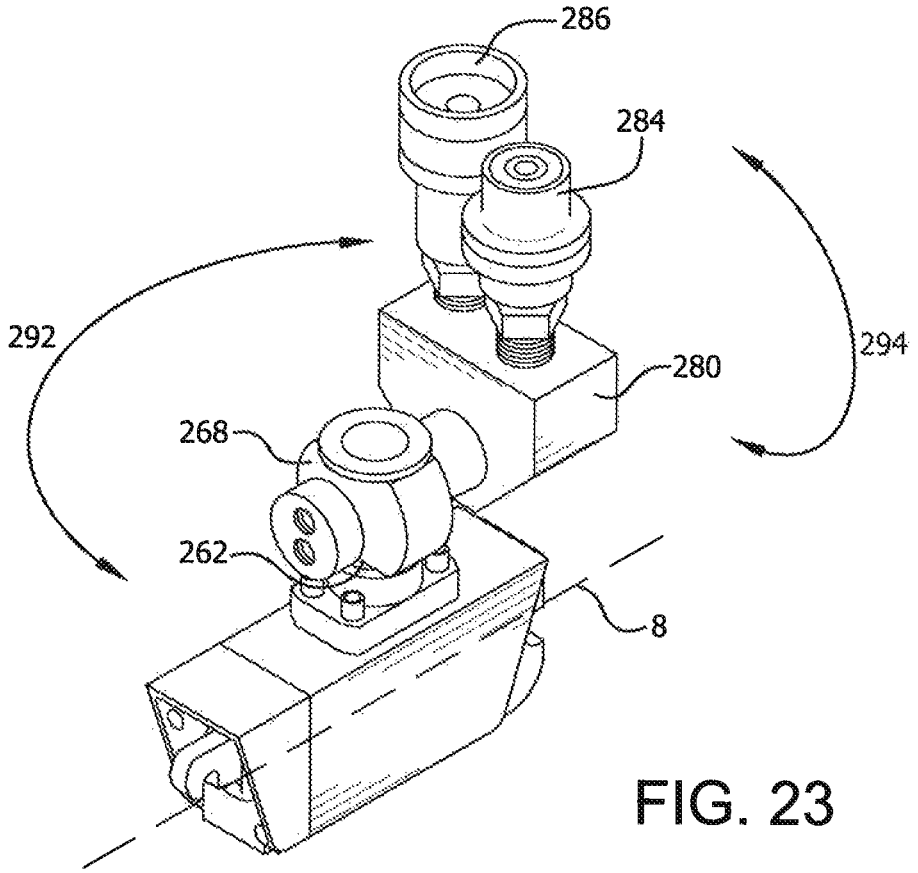
FIG. 23 illustrates the functioning of the coupler swivel connection of the present invention.

Current hose coupling swivel connections, as illustrated in FIG. 22, allow rotation 290 in only a single plane, parallel to longitudinal axis 8 of power head 1. By the unique configuration of hose coupling swivel connection 260 of the present invention, port block 280 is rotatable 360°×360°, 292 and 294, in two distinct planes perpendicular to each other, one plane parallel to longitudinal axis 8 and one plane perpendicular to this longitudinal axis. This provides significant additional versatility to the manner and positions which hydraulic fluid hoses can be connected to the torque wrench of the present invention.

Most advantageously, arm element 268 can readily be utilized with current single plane swivel connections, such as is shown in FIG. 22. In fact, it can be an add-on component to any swivel connection with similar port blocks and port stems, to provide additional rotational versatility to house coupler connections.

Certain novel features and components of this invention are disclosed in detail in order o make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A hydraulic wrench power head comprising a longitudinal axis extending along the center line of the power head, a cylinder, a port stem component located completely on top of the cylinder, said port stem component having a port stem base section located cylinder, a port stem section extending up from the port stem base section, and a port block connected to hydraulic hose couplers, said power head having a forward connecting component and a rear connecting receptacle, the forward connecting component and the rear connecting receptacle being located said longitudinal axis of the power head; and an interchangeable link cartridge drives drive, separate and independent from the power head for insertion into the power head and separable for removal from the power head, said cartridge drive having a longitudinal axis, a forward latch, a rear reaction pin, and an internal channel bounded by sidewalls sized to receive said power head, whereby upon insertion of the cartridge drive into the power head, the reaction pin of the cartridge drive engages the connecting receptacle of the power head and the forward connecting component of the power head attaches to the forward latch of the cartridge drive within internal channel, thereby forming a single, integral hydraulic torque wrench unit with the longitudinal axis of the power head being parallel to and aligned with the longitudinal axis of the cartridge drive and the torque line of the unit extending through the center line of the power head and rear reaction pin of the cartridge drive.

2. The system as in claim 1 wherein said link cartridge drive comprises a housing through which its longitudinal axis extends, and in which the power head is inserted, and an integral ratchet section extending from the housing.

3. The system as in claim 1 wherein said link cartridge drives drive comprises a housing through which its longitudinal axis extends, and in which the power head is inserted, and a ratchet cassette section comprising a channel receptacle with two different sized female keyway slots to which a plurality of different, independent ratchet cassettes are individually connected.

4. The system as in claim 2 wherein said link cartridge drive further comprises a ratchet and ratchet square extending from the ratchet section.

5. The system as in claim 3 wherein said one of the plurality of ratchet cassettes comprises a drive plate having first and second half sections, the drive plate enclosing a ratchet having flat interior surfaces and exterior ratchet teeth adjacent to internal surfaces of the drive plate.

6. The system as in claim 5 in which the first half section has a male keyway and the second half section has a male keyway larger than the first half section keyway, whereby said drive plate is connected to the ratchet cassette section solely by the insertion of the larger male keyway into the larger female keyway slot and the insertion of the smaller male key way into the smaller keyway slot.

7. The system as in claim 4 further comprising a locking system to maintain the ratchet square drive in a first position extending out from one side of the housing and in a second position extending out from the opposite side of housing.

8. The system as in claim 7 wherein the locking system comprises a square drive ball element biasedly held within one of two square drive detents by a square drive spring, wherein when the ball element is biased within the first detent the ratchet square drive is in the first extended position and when the ball element is biasedly held within the second detent, the ratchet square drive is in the second extended position.

9. The system as in claim 4 in which said link cartridge drive comprises a reaction arm and a reaction arm adjustment system for positioning and locking said reaction arm in a plurality of different configurations in relation to the housing.

10. The system as in claim 9 wherein the reaction arm adjustment system comprises a channel extending along the outer surface of the housing, a reaction block having an upper section slideable along the channel and a lower section slideable within the reaction arm, and a reaction arm ball plunger biasedly held within the upper and lower sections of the reaction arm block by a reaction arm spring, whereby slideable movement of the reaction arm block along the channel and of the reaction arm along the lower section of the reaction arm block permits adjustment of the reaction arm in said plurality of different configurations in relation to the housing.

11. The system as in claim 10 wherein the reaction arm is immovably positioned in each of the plurality of configurations by the biased engagement of the reaction arm ball between the reaction arm and the housing.

12. The system as in claim 2 further comprising a ratchet having circumferential teeth located and being rotatable within the ratchet section, and a reaction pawl to control the rotatable movement of the ratchet within the ratchet section, said pawl being attached to the housing of the link cartridge drive and having an. end section with pawl teeth, whereby the reaction pawl is rotatable between a first position in which the teeth of its end section engage the circumferential teeth of the ratchet to prevent rotatable movement of the ratchet within the ratchet section, and a second position in which the teeth of the end section are disengaged from the circumferential teeth of the ratchet to allow rotatable movement of ratchet within the ratchet section.

13. The system as in claim 12 wherein the reaction pawl is rotatably biased by a spring to maintain the pawl in said first position and when the pawl is pushed against the bias of the spring, the pawl is rotated to the second position.

14. The system as in claim 13 further comprising paw! teeth locking means for immoveably maintaining the reaction pawl in the second position against the bias of the spring.

15. The system as in claim 1 further comprises an arm element having an opening through which the port stein section extends, the arm element being rotatable 360° within a first plane around the port stem section, said arm element further comprising an extended end section extending through the port block, the port block being rotatable 360° within a second plane perpendicular to the first plane around the extended end section, thereby providing 360° by 360° rotation of the hydraulic couplers within the two different planes.

16. A hydraulic wrench system comprising:

a hydraulic wrench power head comprising a longitudinal axis extending along the center line of the power head, a port stem, component having a port stem base section located on the power head, a port stem section extending up from the port stem base section, and a port block connected to hydraulic hose couplers, said power head having a forward connecting component and a rear connecting receptacle, the forward connecting component and the rear connecting receptacle being located on the center line of the power head; and an interchangeable link cartridge drive for insertion into the power head, said cartridge drive having a longitudinal axis, a forward latch, a rear reaction pin, a housing through which its longitudinal axis extends, and in which the power head is inserted, and a ratchet cassette section comprising a channel receptacle with two different sized female keyway slots to which a plurality of different, independent ratchet cassettes are individually connected, whereby upon insertion of the cartridge drive into the power head, the reaction pin of the cartridge drive engages the connecting receptacle of the power head and the forward connecting component of the power head attaches to the forward latch of the cartridge drive, forming a single, integral hydraulic torque wrench unit with the longitudinal axis of the power head being parallel to and aligned with the longitudinal axis of the cartridge drive and the torque line of the unit extending through the center line of the power head and rear reaction pin of the cartridge drive.

17. The system as in claim 16 wherein said one of the plurality of ratchet cassettes comprises a drive plate having first and second half sections, the drive plate enclosing a ratchet having flat interior surfaces and exterior ratchet teeth adjacent to internal surfaces of the drive plate.

18. The system as in claim 17 in which the first half section has a male keyway and the second half section has a male keyway larger than the first half section keyway, whereby said drive plate is connected to the ratchet cassette section solely by the insertion of the larger male keyway into the larger female keyway slot and the insertion of the smaller male keyway into the smaller keyway slot.

19. The system as in claim 1 wherein the port block circumscribes the port stem section.

20. A hydraulic wrench system comprising:

a hydraulic wrench power head comprising a longitudinal axis extending along the center line of the power head, a port stem component having a port stem base section iocated on the power head, a port stem section extending up from the port stem base section, and a port block connected to hydraulic hose couplers, said power head having a forward connecting component located on the center line of the power head: and an interchangeable link cartridge drive for insertion into the power head, said cartridge drive having a longitudinal axis, a forward latch, a rear reaction pin, a housing through which its longitudinal axis extends, and in which the power head is inserted, and a ratchet cassette section comprising a channel receptacle with two different sized female keyway slots to which a plurality of different, independent ratchet cassettes are individually connected, whereby upon insertion of the cartridge drive into the power head, the forward connecting component of the power head attaches to the forward latch of the cartridge drive, forming a single, integral hydraulic torque wrench unit with the longitudinal axis of the power head being parallel to and aligned with the longitudinal axis of the cartridge drive and the torque line of the unit extending through the center line of the power head and rear reaction pin of the cartridge drive.

21. The system as in claim 20 wherein said one of the plurality of ratchet-cassettes comprises a drive plate having first and second half sections, the drive plate enclosing a ratchet having flat interior surfaces and exterior ratchet teeth adjacent to internal surfaces of the drive plate.

22. The system as in claim 21 in which the first half section has a male keyway and the second half section has a male keyway larger than the first half section key way, whereby said drive plate is connected to the ratchet cassette section solely by the insertion of the larger male key way into the larger female keyway slot and the insertion of the smaller male key way into the smaller keyway slot.

* * * * *